US010343750B1

(12) United States Patent
Heinmiller et al.

(10) Patent No.: US 10,343,750 B1
(45) Date of Patent: Jul. 9, 2019

(54) SPILLED FUEL COLLECTION SYSTEM

(71) Applicants: Wesley Heinmiller, Deer Harbor, WA (US); Alan Stameisen, Deer Harbor, WA (US)

(72) Inventors: Wesley Heinmiller, Deer Harbor, WA (US); Alan Stameisen, Deer Harbor, WA (US)

( * ) Notice: Subject to any disclaimer, the term of this patent is extended or adjusted under 35 U.S.C. 154(b) by 0 days.

(21) Appl. No.: 16/018,214

(22) Filed: Jun. 26, 2018

(51) Int. Cl.

| | |
|---|---|
| ***B63B 17/00*** | (2006.01) |
| ***B63B 25/08*** | (2006.01) |
| ***B67D 7/04*** | (2010.01) |
| ***B67D 7/32*** | (2010.01) |

(52) U.S. Cl.
CPC ..... *B63B 17/0036* (2013.01); *B63B 25/082* (2013.01); *B67D 7/049* (2013.01); *B67D 7/0492* (2013.01); *B67D 7/3209* (2013.01)

(58) Field of Classification Search
CPC ... B63B 17/0036; B63B 25/082; B67D 7/049; B67D 7/0192; B67D 7/3209
See application file for complete search history.

(56) References Cited

U.S. PATENT DOCUMENTS

| | | | | |
|---|---|---|---|---|
| 4,082,125 | A | 4/1978 | Wilson | |
| 5,230,372 | A | 7/1993 | Westphal | |
| 5,322,099 | A * | 6/1994 | Langlois | B60K 15/03519 114/343 |
| 5,469,800 | A | 11/1995 | Brotz | |
| 5,715,876 | A | 2/1998 | Burt | |
| 5,762,114 | A | 6/1998 | Petersen | |
| D399,477 | S | 10/1998 | Garvey, III | |
| 5,894,809 | A * | 4/1999 | Grigaitis | B63B 25/082 114/343 |
| 6,167,911 | B1 | 1/2001 | Diamond | |
| 6,935,264 | B2 * | 8/2005 | Harris | B63B 25/082 114/343 |
| 7,380,542 | B1 | 6/2008 | Herrington | |
| 2009/0283174 | A1 * | 11/2009 | Mitchell | F02M 37/00 141/1 |
| 2016/0059275 | A1 * | 3/2016 | Smedley | B08B 5/04 134/21 |

FOREIGN PATENT DOCUMENTS

| | | |
|---|---|---|
| WO | 2005045303 | 6/2005 |

* cited by examiner

*Primary Examiner* — Stephen P Avila
(74) *Attorney, Agent, or Firm* — Kyle A. Fletcher, Esq.

(57) ABSTRACT

The spilled fuel collection system is configured for use with the fuel vent of a vessel. The fuel vent is designed to release gas and fuel during an event selected from the group consisting of: a) a build-up of gas pressure within the fuel tank; and, b) overfilling the fuel tank with fuel. The spilled fuel collection system is an accessory that captures fuel and fuel vapors that escape through the fuel vent of a vessel during the fueling process. The spilled fuel collection system comprises a transportable fuel container, a hose, and a quick connect fitting. The transportable fuel container captures the fuel and vapor that escape through the fuel vent. The hose transports the escaped fuel and vapor from the fuel vent into the transportable fuel container. The quick connect fitting secures the hose to the fuel vent.

15 Claims, 3 Drawing Sheets

SPILLED FUEL COLLECTION SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of combustion engines and feeding fuel into combustion engines from a storage container, more specifically, an arrangement for capturing fuel spilled during the fueling procedure.

Summary of Invention

The spilled fuel collection system is configured for use with a vessel. The vessel is further configured with a fuel system, which is further configured with a fuel vent. The fuel vent is designed to release gas and fuel during an event selected from the group consisting of: a) a build-up of gas pressure within the fuel tank; and, b) overfilling the fuel tank with fuel. The spilled fuel collection system is an accessory that captures fuel and fuel vapors that escape through the fuel vent of a vessel during the fueling process. The spilled fuel collection system comprises a transportable fuel container, a hose, and a quick connect fitting. The transportable fuel container captures the fuel and vapor that escape through the fuel vent. The hose transports the escaped fuel and vapor from the fuel vent into the transportable fuel container. The quick connect fitting secures the hose to the fuel vent.

These together with additional objects, features and advantages of the spilled fuel collection system will be readily apparent to those of ordinary skill in the art upon reading the following detailed description of the presently preferred, but nonetheless illustrative, embodiments when taken in conjunction with the accompanying drawings.

In this respect, before explaining the current embodiments of the spilled fuel collection system in detail, it is to be understood that the spilled fuel collection system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the spilled fuel collection system.

It is therefore important that the claims be regarded as including such equivalent construction insofar as they do not depart from the spirit and scope of the spilled fuel collection system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
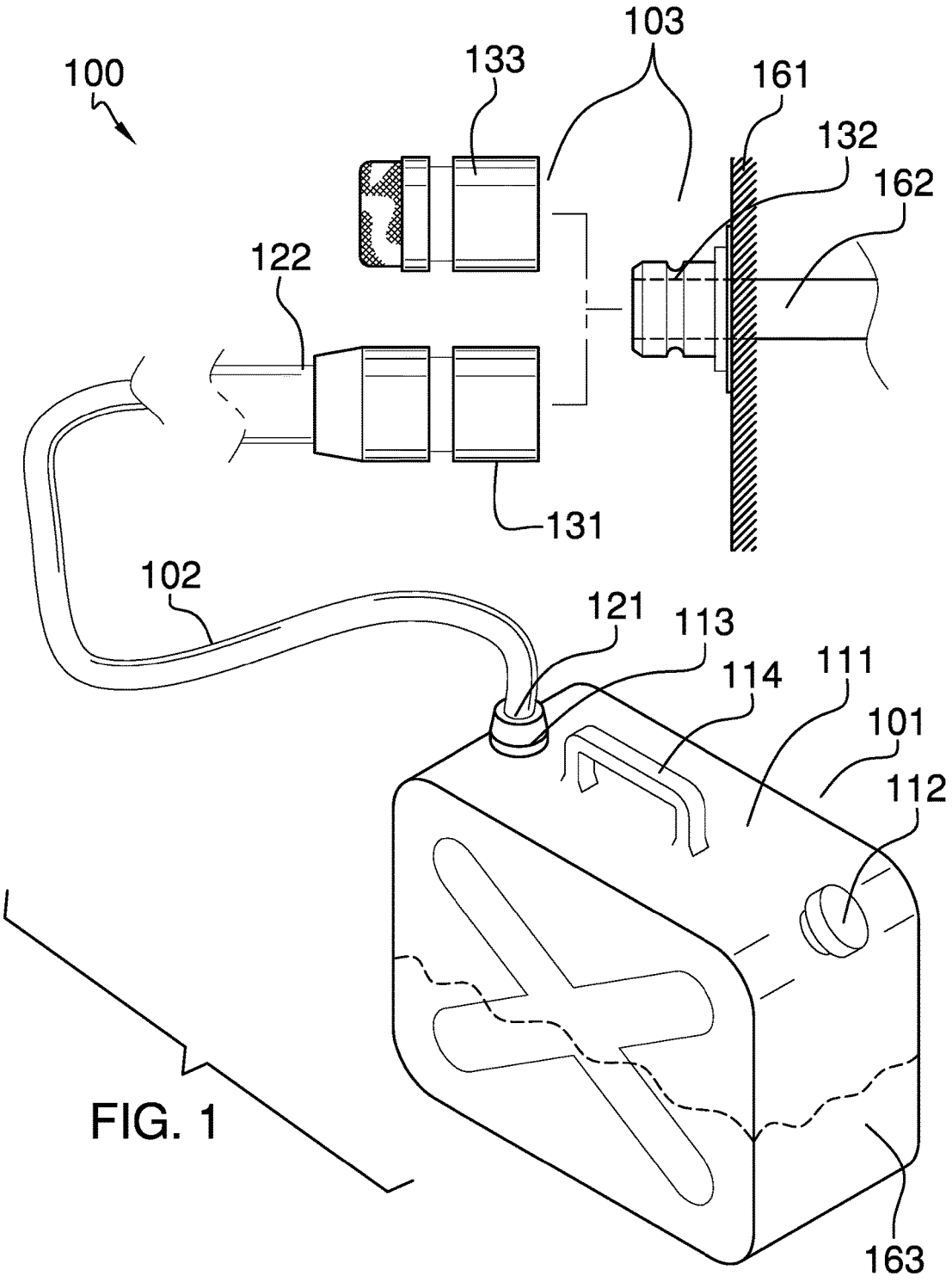
FIG. 1 is a perspective view of an embodiment of the disclosure.
Figure 2:
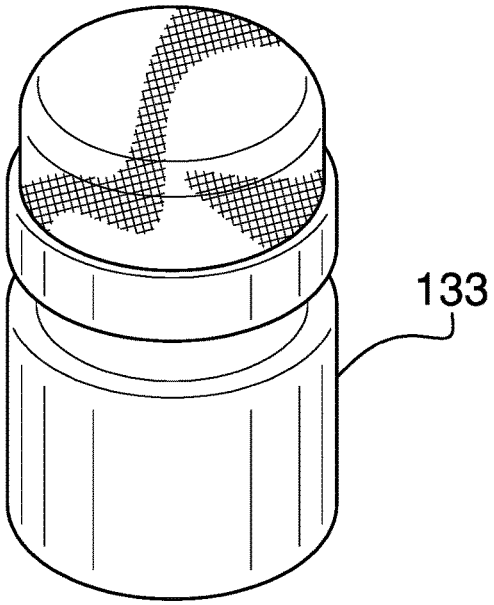
FIG. 2 is a detail view of an embodiment of the disclosure.
Figure 3:
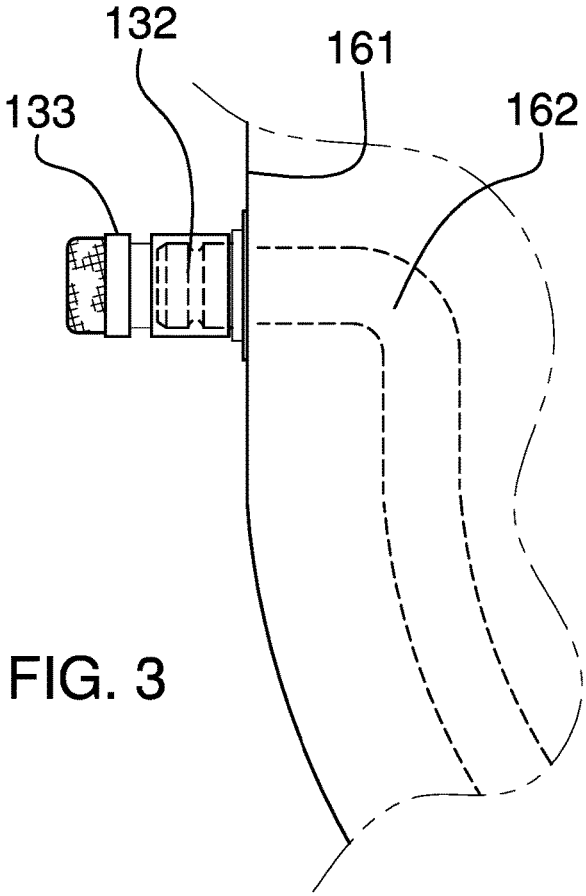
FIG. 3 is another detail view of an embodiment of the disclosure.
Figure 4:
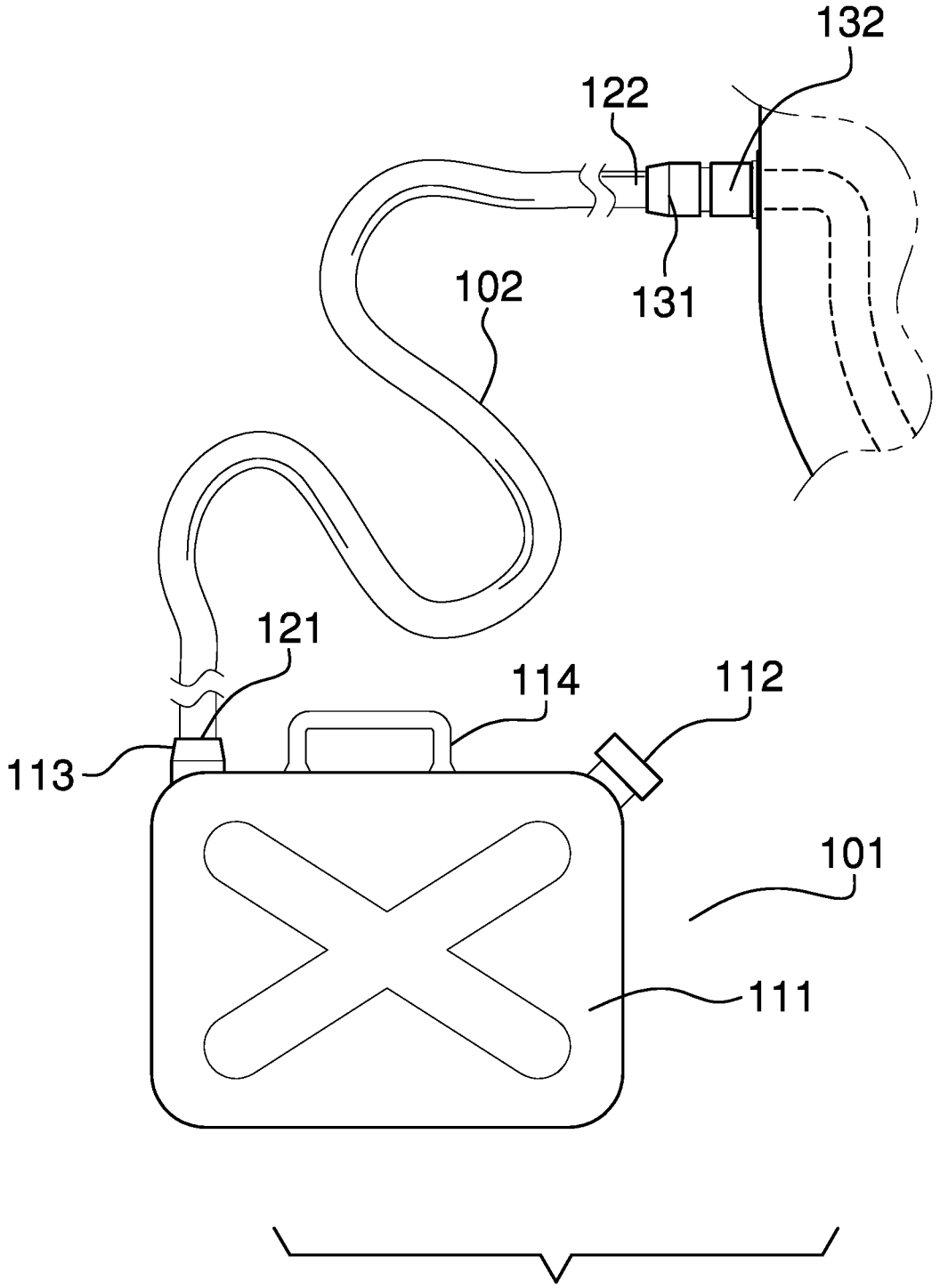
FIG. 4 is an in-use view of an embodiment of the disclosure.

Detailed reference will now be made to one or more potential embodiments of the disclosure, which are illustrated in FIGS. 1 through 4.

The spilled fuel collection system 100 (hereinafter invention) is configured for use with a vessel 161. The vessel 161 is further configured with a fuel system, which is further configured with a fuel vent 162. The fuel vent 162 is designed to release fuel and fuel vapor during an event selected from the group consisting of: a) a build-up of gas pressure within the fuel tank; and, b) overfilling the fuel tank with fuel. The invention 100 is an accessory that captures fuel and fuel vapor 163 that escape through the fuel vent 162 of a vessel 161 during the fueling process. The invention 100 comprises a transportable fuel container 101, a hose 102, and a quick connect fitting 103. The transportable fuel container 101 captures the fuel and fuel vapor 163 that escape through the fuel vent 162. The hose 102 transports the escaped fuel and fuel vapor 163 from the fuel vent 162 into the transportable fuel container 101. The quick connect fitting 103 secures the hose 102 to the fuel vent 162.

The transportable fuel container 101 is a container configured for use in transporting fuel. The transportable fuel container 101 is a commercially available product similar to what is commonly referred to as a jerry can. The transportable fuel container 101 comprises a fuel can 111, a closable vent 112, an inlet 113, and a handle 114.

The fuel can 111 is a hollow containment structure. The fuel can 111 is configured to hold fuel. The fuel can 111 receives and condenses the escaped fuel and fuel vapor 163 from the fuel vent 162 that has been transported into the transportable fuel container 101 through the hose 102.

The closable vent 112 is an aperture that is formed through the exterior surface of the fuel can 111. The closable vent 112 is opened when the fuel can 111 is collecting the escaped fuel and fuel vapor 163 such that the pressure between the fuel can 111 and the atmosphere remains equalized through the fueling process. The closable vent 112 prevents back pressure from building within the fuel can 111 that would otherwise create an inadvertent fuel spill. The closable vent 112 can be sealed after the fueling process such that any escaped fuel and fuel vapor 163 captured in the transportable fuel container 101 will remain contained in the transportable fuel container 101.

The inlet 113 is an aperture that is formed through the exterior surface of the fuel can 111. The hose 102 attaches to the inlet 113 such that the escaped fuel and fuel vapor 163 captured through the quick connect fitting 103 deposits into the fuel can 111 through the inlet 113. The hose 102 permanently attaches to the inlet 113.

The handle 114 is a grip formed in the fuel can 111 such that the transportable fuel container 101 can be transported by hand.

The hose 102 is a hollow tubular structure. The hose 102 forms a fluidic connection between the fuel vent 162 of the vessel 161 and the transportable fuel container 101 such that any escaped fuel and fuel vapor 163 discharged from the fuel vent 162 during the fueling process is captured and condensed within the transportable fuel container 101. The hose 102 is a commercially available product. The hose 102 is further defined with a first end 121 and a second end 122.

The quick connect fitting 103 is a plug and port arrangement that provides a fluid impermeable connection between the hose 102 and the fuel vent 162 of the vessel 161. The quick connect fitting 103 is a commercially available product. The quick connect fitting 103 is defined in greater detail elsewhere in this disclosure. The quick connect fitting 103 comprises a hose connector 131, a vessel 161 connector 132, and a vessel 161 connector port 133.

The hose connector 131 is the portion of the quick connect fitting 103 attached to the hose 102. In the first potential embodiment of the disclosure, the hose connector 131 is a port-type connector. The vessel 161 connector 132 is the portion of the quick connect fitting that attaches to the fuel vent 162 of the vessel 161. In the first potential embodiment of the disclosure, the vessel 161 connector 132 is a plug-type connector.

The vessel 161 connector port 133 is a port-type connection that attaches to the vessel 161 connector 132 when the vessel 161 is not being fueled. The vessel 161 connector port 133: a) allows fuel and vapor to escape the vessel 161 when required for safety purposes; while, b) preventing debris from entering the vessel 161 connector 132. In the first potential embodiment of the disclosure, the vessel 161 connector port 133 uses a screen to prevent debris from entering the vessel 161 connector port 133 while allowing fuel and vapor to escape.

This paragraph describes the assembly of the invention 100. The vessel 161 connector 132 of the quick connect fitting 103 attaches to the fuel vent 162 of the vessel 161. The hose connector 131 of the quick connect fitting 103 attaches to the second end 122 of the hose 102. The first end 121 of the hose 102 permanently attaches to the inlet 113 of the transportable fuel container 101.

This paragraph describes the use of the invention 100. To use the invention 100, the closable vent 112 is opened such that the air flows into and out of the transportable fuel container 101. The vessel 161 connector port 133 of the quick connect fitting 103 is removed from the fuel vent 162 of the vessel 161. The hose connector 131 of the quick connect fitting 103 inserts into the vessel 161 connector 132 of the quick connect fitting 103 such that the hose 102 forms a fluidic connection between the fuel vent 162 and the transportable fuel container 101. The vessel 161 is then fueled normally. After fueling, the vessel connector port 133 of the quick connect fitting 103 reattaches to the fuel vent 162 of the vessel 161.

The following definitions were used in this disclosure:

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connection are well-known and documented in the mechanical, chemical, and plumbing arts.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Hose: As used in this disclosure, a hose is a flexible hollow cylindrical device used for transporting liquids and gases. When referring to a hose in this disclosure, the terms inner diameter and outer diameter are used as they would be used by those skilled in the plumbing arts.

Plug: As used in this disclosure, a plug is an object used: 1) as a barrier to block access to a cavity or an aperture; or, 2) a connection device inserts into a port, cavity, or aperture for the purpose of attaching a first object to a second object.

Port: As used in this disclosure, a port is a cavity formed in an object that is adapted to receive a plug.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Quick Connect Fitting: As used in this disclosure, a quick connect fitting is a coupling that is used in fluid flow applications to quickly connect or disconnect two lines or two objects through which fluids will flow. Connections or disconnections are intended to be done by hand without the use of tools. Quick connect fittings readily and commercially available and methods for their selection and use well known and documented in the mechanical, chemical, and plumbing arts.

Reservoir: As used in this disclosure, a reservoir refers to a container or containment system that is configured to store a liquid.

Tube: As used in this disclosure, a tube is a hollow prism-shaped device formed with two open ends. The tube is used for transporting liquids and gases. The line that connects the center of the first congruent face of the prism to the center of the second congruent face of the prism is referred to as the center axis of the tube or the centerline of the tube. When two tubes share the same centerline, they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Vent: As used in this disclosure, a vent is an opening in a structure that allows for the flow of gas through the boundary of the structure.

Vehicle: As used in this disclosure, a vehicle is a motorized device used for transporting passengers, goods, or equipment. The term motorized vehicle refers to a vehicle can move under power provided by an electric motor or an internal combustion engine.

Vessel: As used in this disclosure, a vessel is a type of vehicle. A vessel transports passengers, goods, or equipment over water.

With respect to the above description, it is to be realized that the optimum dimensional relationship for the various components of the invention described above and in FIGS. 1 through 3 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An apparatus for capturing spilled fuel comprising:

a transportable fuel container, a hose, and a quick connect fitting;

wherein the transportable fuel container and the quick connect fitting attach to the hose;

wherein the apparatus for capturing spilled fuel is configured for use with a vessel;

wherein the vessel is further configured with a fuel system which is further configured with a fuel vent;

wherein the fuel vent is designed to release fuel and fuel vapor during an event selected from the group consisting of: a) a build-up of gas pressure within the fuel tank; and, b) overfilling the fuel tank with fuel;

wherein the apparatus for capturing spilled fuel is an accessory that captures fuel and fuel vapor that escape through the fuel vent of a vessel during the fueling process;

wherein the quick connect fitting secures the hose to the fuel vent;

wherein the hose transports the escaped fuel and fuel vapor from the fuel vent into the transportable fuel container;

wherein the transportable fuel container captures the fuel and fuel vapor that escape through the fuel vent;

wherein the transportable fuel container comprises a fuel can, a closable vent, an inlet, and a handle;

wherein the closable vent, the inlet, and the handle are formed in the fuel can;

wherein the fuel can is a hollow containment structure;

wherein the fuel can is configured to hold fuel;

wherein the fuel can receives and condenses the escaped fuel and fuel vapor from the fuel vent that has been transported into the transportable fuel container through the hose;

wherein the closable vent is an aperture;

wherein the closable vent is formed through the exterior surface of the fuel can;

wherein the closable vent equalizes the pressure between the fuel can and the atmosphere.

2. The apparatus for capturing spilled fuel according to claim 1 wherein the inlet is an aperture that is formed through the exterior surface of the fuel can.

3. The apparatus for capturing spilled fuel according to claim 2 wherein the hose attaches to the inlet such that the escaped fuel and fuel vapor captured through the quick connect fitting deposits into the fuel can through the inlet.

4. The apparatus for capturing spilled fuel according to claim 3 wherein the hose permanently attaches to the inlet.

5. The apparatus for capturing spilled fuel according to claim 4 wherein the handle is a grip;

wherein the handle is formed in the fuel can such that the transportable fuel container held by hand.

6. The apparatus for capturing spilled fuel according to claim 5 wherein the hose is a hollow tubular structure;

wherein the hose is further defined with a first end and a second end;

wherein the hose forms a fluidic connection between the fuel vent of the vessel and the transportable fuel container such that any escaped fuel and fuel vapor discharged from the fuel vent during the fueling process is captured within the transportable fuel container.

7. The apparatus for capturing spilled fuel according to claim 6 wherein the quick connect fitting is a plug and port arrangement that provides a fluidic connection between the hose and the fuel vent of the vessel.

8. The apparatus for capturing spilled fuel according to claim 7 wherein the quick connect fitting comprises a hose connector, a vessel connector, and a vessel connector port;

wherein the vessel connector port removably attaches to the vessel connector;

wherein the hose connector removably attaches to the vessel connector.

9. The apparatus for capturing spilled fuel according to claim 8 wherein the hose connector is a port-type connector;

wherein the vessel connector is a plug-type connector;

wherein the vessel connector port is a port-type connection.

10. The apparatus for capturing spilled fuel according to claim 9 wherein the hose connector attaches to the hose;

wherein the vessel connector attaches to the fuel vent of the vessel;

wherein the vessel connector port attaches to the vessel connector when the vessel is not being fueled.

11. The apparatus for capturing spilled fuel according to claim 10 wherein the vessel connector port further comprises a screen.

12. The apparatus for capturing spilled fuel according to claim 11 wherein the vessel connector port: a) allows vapor to escape the vessel when required for safety purposes; while, b) preventing debris from entering the vessel connector.

13. The apparatus for capturing spilled fuel according to claim 12 wherein the vessel connector port further comprises a screen that blocks debris while allowing fluid to pass.

14. The apparatus for capturing spilled fuel according to claim 13 wherein the hose connector of the quick connect fitting attaches to the second end of the hose;

wherein the first end of the hose permanently attaches to the inlet of the transportable fuel container.

15. The apparatus for capturing spilled fuel according to claim 14 wherein during fueling of the vessel the closable vent is opened such that the air flows into and out of the transportable fuel container;

wherein during fueling the hose connector of the quick connect fitting inserts into the vessel connector of the quick connect fitting such that the hose forms a fluidic connection between the fuel vent and the transportable fuel container;

wherein after fueling the vessel connector port of the quick connect fitting reattaches to the fuel vent of the vessel.

* * * * *